US006647973B1

(12) United States Patent
Schueler et al.

(10) Patent No.: US 6,647,973 B1
(45) Date of Patent: Nov. 18, 2003

(54) TWO-STAGE FILTRATION ASSEMBLY FOR A DIESEL ENGINE CRANKCASE VENTILATION SYSTEM

(75) Inventors: Joshua D. Schueler, New Lenox, IL (US); Michael Dean Tombers, Lockport, IL (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/166,812

(22) Filed: Jun. 11, 2002

(51) Int. Cl.[7] ..... F02B 25/06
(52) U.S. Cl. ..... 123/572; 123/573
(58) Field of Search ..... 123/572, 573, 123/574, 41.86

(56) References Cited

U.S. PATENT DOCUMENTS 5,417,184 A * 5/1995 McDowell ..... 123/41.86
5,450,835 A * 9/1995 Wagner ..... 123/573
5,586,996 A * 12/1996 Manookian, Jr. ..... 55/321
6,161,529 A * 12/2000 Burgess ..... 123/572

* cited by examiner

*Primary Examiner*—Bibhu Mohanty
(74) *Attorney, Agent, or Firm*—Cary W. Brooks

(57) ABSTRACT

A two-stage filtration assembly for a diesel engine crankcase ventilation system which prevents splash oil from entering into the oil separator and limits oil mist contamination of crankcase air prior to passing into the exhaust port. A first stage filtration assembly includes a first stage filter featuring a wire mesh filtration media contained by a cylindrical tube with perforated (expanded) steel end caps for removing and draining large oil particles and any oil splashing adjacent to the crankcase. A second stage filtration assembly includes a second stage filter featuring a web filtration media, preferably fiberglass, for removing small, air borne oil particles with a high efficiency during the second phase of filtration. The second stage a filter is mounted on an acute angle to allow drainage via gravity to the first stage filter. A passageway in the first stage filtration assembly allows oil to drain from the second stage filter back to the crankcase. The drains prevent oil re-entrainment into the air stream, allowing maximum effectiveness of the filtration elements.

13 Claims, 4 Drawing Sheets

TWO-STAGE FILTRATION ASSEMBLY FOR A DIESEL ENGINE CRANKCASE VENTILATION SYSTEM

TECHNICAL FIELD

The present invention relates to crankcase ventilation of diesel internal combustion engines, particularly diesel engines used for locomotive applications.

BACKGROUND OF THE INVENTION

Diesel-powered locomotives generally require an absence of positive crankcase pressure. Yet, during the operation of internal combustion engines, blow-by gas from the combustion chamber during the combustion stroke causes a positive pressure in the crankcase which must be relieved. In the case of locomotive applications, it is desired that the crankcase generally be negatively pressured. Accordingly, since a simple valve or opening in the crankcase is inadequate, a crankcase ventilation system is utilized.

The crankcase ventilation system on a locomotive diesel engine evacuates the excessive crankcase air in the crankcase (from seals and piston blow-by) to the exhaust stream and eventually the atmosphere. Included in the crankcase air is an oil mist that has two negative consequences. First, the oil mist contributes to the engine's emissions; and second, the oil leaves a coke deposit of carbon that can ignite and start railside fires.

FIG. 1 exemplifies a conventional diesel engine crankcase ventilation system 10, including an oil separator 12 and an evacuator 14. A pipe connection 16 communicates generally horizontally with the crankcase, as, for example, at an upper portion of the oil pan 18. An elbow 20 connects the pipe connection 16 to the oil separator 12, which has an off-set opening 22. Connected to the off-set opening 22 is the evacuator 14. The evacuator 14 has a vertical portion 24 and a horizontal portion 26 demarcated by a bend 28. The end of the horizontal portion 26 is interfaced with an exhaust port 30 which communicates with the engine exhaust system. The bend 28 is fitted with a nozzle assembly 32. The nozzle assembly 32 includes a single orifice nozzle 34 internal to the horizontal portion 26 which is directed down the horizontal portion toward the exhaust port 26, the horizontal portion diameter outwardly tapering with increasing distance from the nozzle assembly. The nozzle assembly 32 is interfaced with a source of pressurized air external to the crankcase, via an air line 36.

In operation, pressurized air emanating from the nozzle blows air toward the exhaust port, causing a low pressure condition in the vertical portion of the evacuator. This low pressure zone communicates with the crankcase through the oil separator to cause crankcase air to be affirmatively evacuated from the crankcase. Oil-laden crankcase air passes through the oil separator, during which the expanded volume and vertical path combine to cause oil to precipitate out of the crankcase air and then flow back into the crankcase.

Several drawbacks of the conventional diesel engine crankcase ventilation system are yet in need of redress, among those being preventing splash oil from entering into the oil separator and improved elimination of oil mist from the crankcase air prior to passing into the exhaust port.

SUMMARY OF THE INVENTION

The present invention is an oil separator in the form of a two-stage filtration assembly for a diesel engine crankcase ventilation system which prevents splash oil from entering thereinto beyond a first stage of the oil separator and limits oil mist contamination of crankcase air prior to passing out from a second stage of the oil separator into the exhaust port, thus advantageously improving the engine's emissions and reducing oil carryover to the exhaust.

The two-stage filtration assembly according to the present invention uses a two-stage approach to crankcase air filtration to effectively separate the oil from the air. The two-stage filtration assembly includes two filters arranged in series, each supported by a sheet metal fabrication housing that is attached to a port in the crankcase, as, for example, at an upper portion of the oil pan.

A first stage filtration assembly includes a first stage filter featuring a wire mesh filtration media contained by a cylindrical tube with perforated (expanded) steel end caps. The first stage filter is mounted horizontally immediately adjacent to the crankcase port. The function of the first stage filter is to remove the large oil particles and any oil splashing adjacent the crankcase. There is a passage associated with the filter which is free of the wire mesh media so as to allow oil to drain from the second stage filter (to be described next) back to the crankcase, thereby the second stage filter to be more effective.

A second stage filtration assembly includes a second stage filter featuring a web filtration media, preferably fiberglass, and is mounted at an acute angle (for example, 20 degrees with respect to horizontal), angling downwardly toward the first stage filtration assembly. The second stage filter is preferably of a hollow cavity cylindrical configuration arranged in the housing such that air from the first stage filter passes through one end into the cavity of the second stage filter, and then passes out through the filter media. The function of the second stage filter is to remove small, airborne oil particles with a high efficiency during the second phase of filtration. Overall advantages of the two-stage filtration system include: removal of oil mist; prevention of railside fires (locomotive applications); and reduction of engine harmful emissions An evacuator is interfaced with the housing to provide a negative pressure downstream of the second stage filter so as to draw crankcase air from the crankcase to an exhaust port.

In operation, in response to operation of the evacuator, crankcase air flows from the crankcase, through the two-stage filter, through the air evacuation system and then out an exhaust port. The first stage filter serves to keep splashed oil and large oil droplets from migrating to the second stage filter, this oil draining back to the crankcase. At the second stage filter, smaller oil particles that the first stage filter could not eliminate are now filtered out of the crankcase air, wherein oil droplets that form thereat will drain back to the crankcase. The crankcase air that makes it through both the first and second stage filters has had a great amount of oil removed, and flows to the exhaust of the engine in an acceptable composition from its original state. The removed oil is drained back to the crankcase without re-entrainment into the air stream. In this regard, the first stage filter has a low oil removal efficiency which eliminates large oil droplets and oil splashing, while the second stage filter has a high oil removal efficiency which eliminates smaller oil particles suspended in the crankcase air without getting overwhelmed because to the earlier passage of the crankcase air through the first stage filter. The principle of using two different filters, respectively, for two different ranges of oil particle size maximizes the amount of oil that can be withdrawn from the crankcase air of the diesel engine because both types of filters are operating at their respective peak efficiency.

Accordingly, it is an object of the present invention to provide effective oil filtration in connection with a crankcase air ventilation system of a diesel engine.

It is an additional object of the present invention to provide effective oil filtration in connection with a crankcase air ventilation system of a diesel engine, wherein two-stage filtration provides removal of oil droplets progressively over two ranges of oil particle sizes, ranging from a larger size first range to a smaller size second range, so as to thereby provide the advantages of oil mist removal, prevention of railside fires, and reduced harmful emissions.

These and additional objects, features and advantages of the present invention will become clearer from the following specification of a preferred embodiment.

DESCRIPTION OF THE PREFERRED EMBODIMENT

Figure 1:
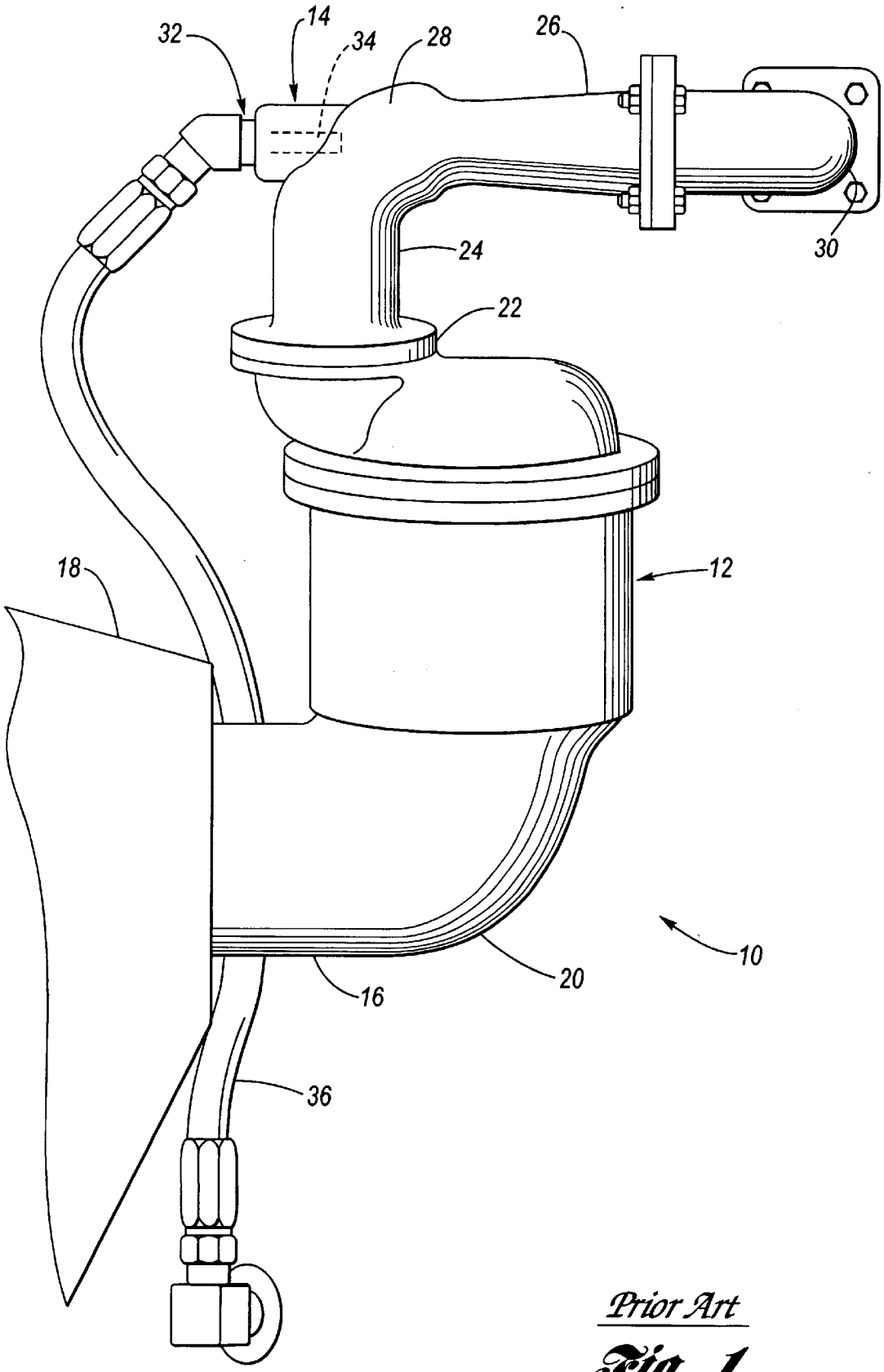
Prior Art Fig. 1
FIG. 1 is a side view of a conventional crankcase ventilation system for a diesel engine.

Referring now to the drawings, FIGS. 2 through 5C depict an example of an oil separator in the form of a two-stage filtration assembly 100 according to the present invention, shown in conjunction with an evacuator 102 of a diesel engine 104. While the diesel engine 104, by way of exemplification, is used to power a locomotive, other similar applications may include, for example, power generation and marine applications.

Figure 2:
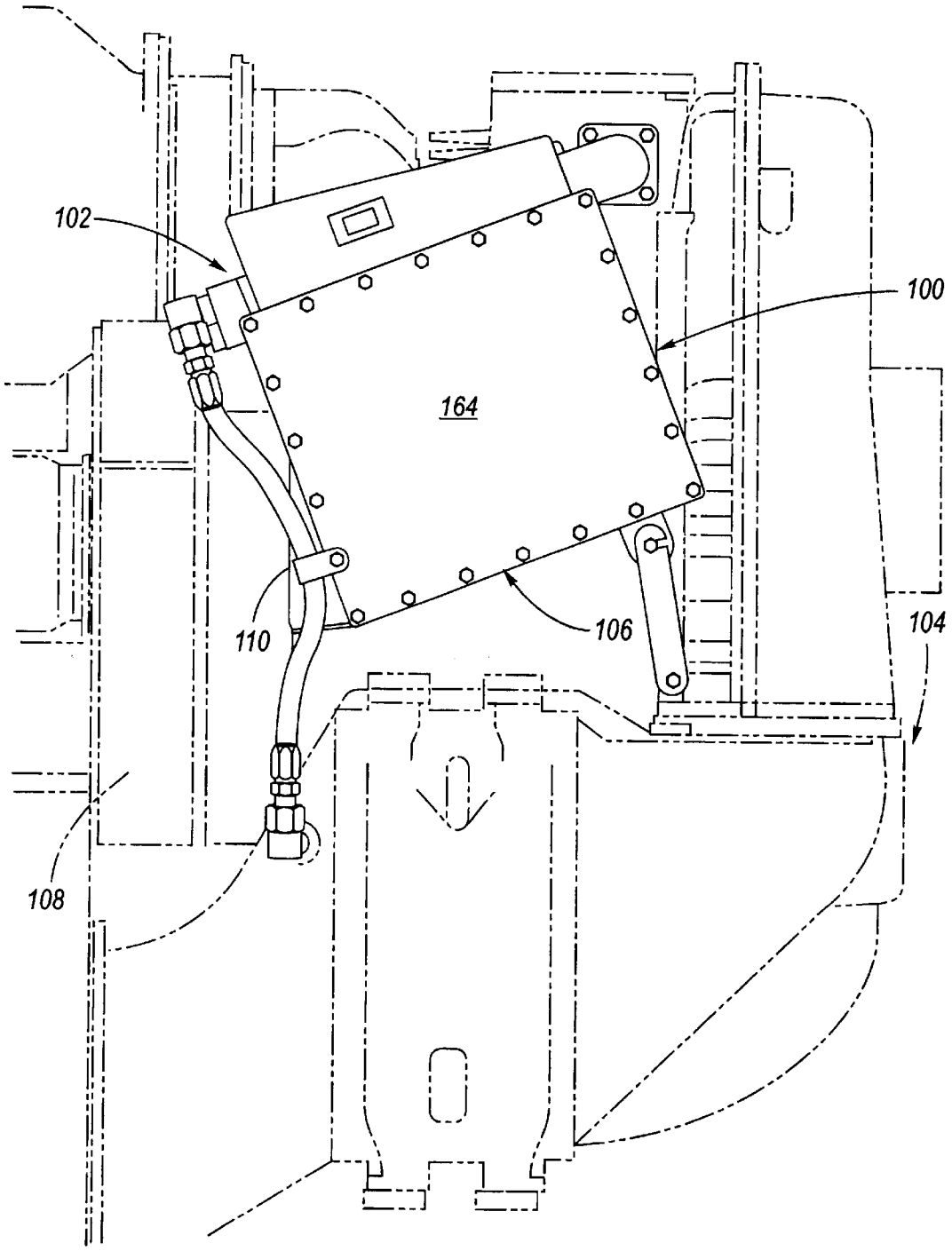
FIG. 2 is a side view of a two-stage filtration assembly for a crankcase ventilation system of a diesel engine according to the present invention.
Figure 3:
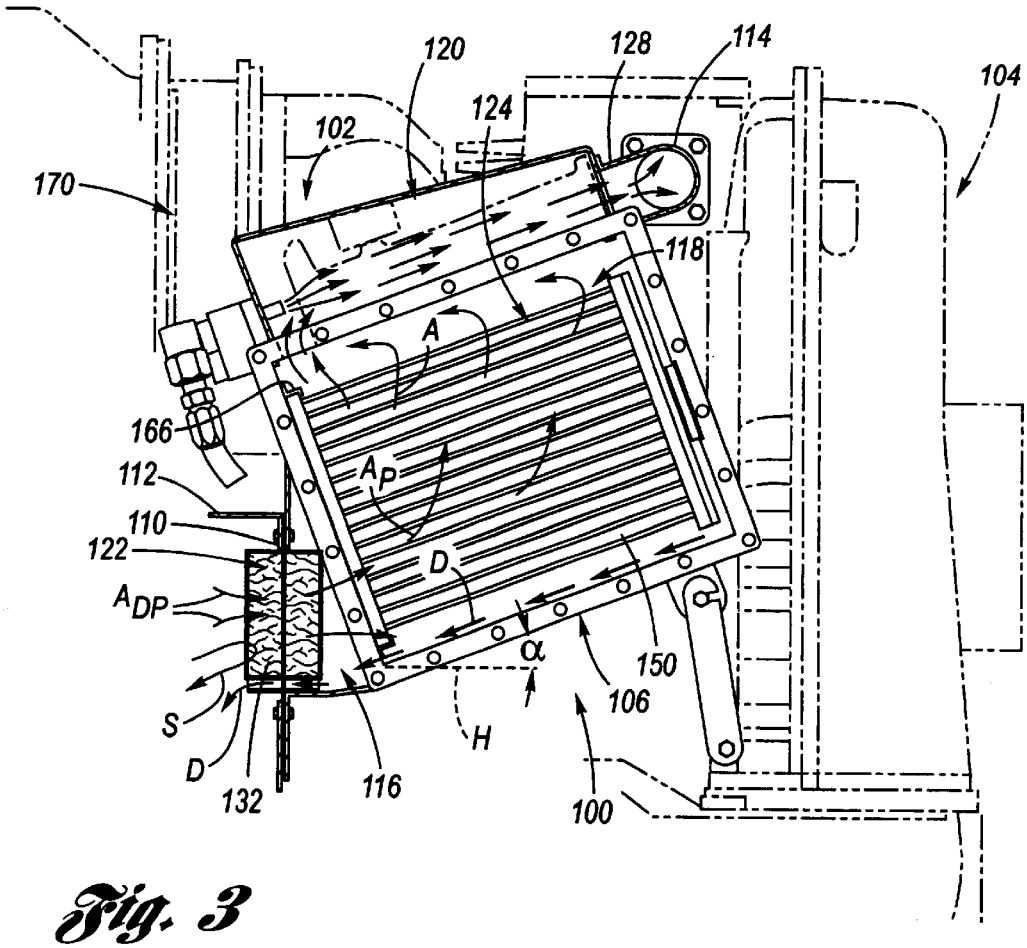
FIG. 3 is a partly sectional side view of the two-stage filtration assembly of FIG. 2.

As can be understood from reference to FIGS. 2 and 3, a housing 106 provides a conduit for crankcase air from the crankcase 108 of the diesel engine 104, as for example a crankcase port 110 located at a top portion of the oil pan, as for example the turbo housing 112 which communicates with the oil pan, to an exhaust port 114 which is in communication with the exhaust system of the engine. The housing 106 is a sheet metal fabrication and includes a first stage chamber 116, a second stage chamber 118 and an evacuation chamber 120. The first stage chamber 116 interfaces with a first stage filtration assembly 122 and connects with the crankcase port 110. The second stage chamber houses a second stage filtration assembly 124 which is serially in communication with the first stage chamber. The evacuation chamber 120 is operably interfaced with the evacuator 102 and is in communication, at one end thereof, with the second stage chamber and, at the other end thereof via suitable piping 128, with the exhaust port 114.

Figure 4A:
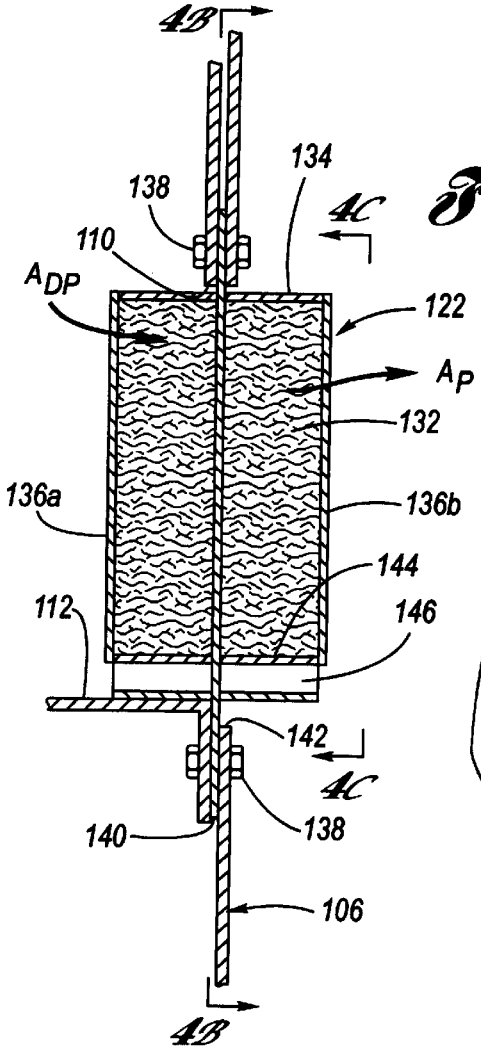
FIG. 4A is a partly sectional side view of a first stage filter of the two-stage filtration assembly according to the present invention.
Figure 4B:
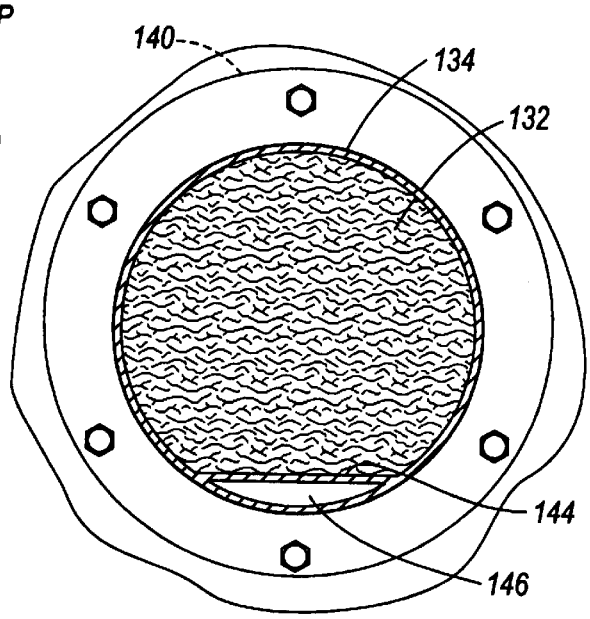
FIG. 4B is a partly sectional end view seen along line 4B—4B in FIG. 4A.
Figure 4C:
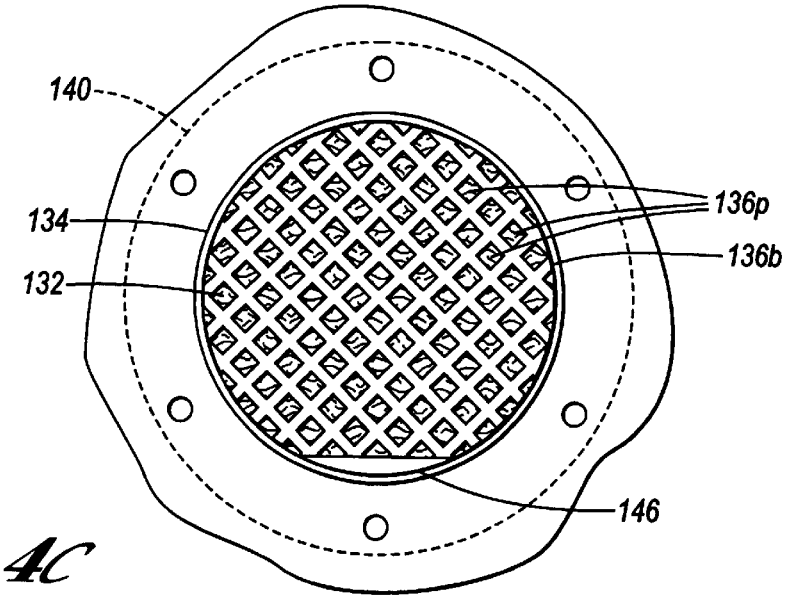
FIG. 4C is a partly sectional end view seen along line 4C—4C in FIG. 4A.

Referring now additionally to FIGS. 4A through 4C, the first stage filtration assembly 122 will be discussed.

The first stage filtration assembly 122 includes a first stage filter 132 characterized by a wire mesh filtration media contained by a cylindrical metallic tube 134 and expanded steel end caps 136*a*, 136*b* having perforations 136*p*. The end caps 136*a*, 136*b* are mounted (as, for example, by welding) to the tube 134. The first stage filtration assembly 122 is mounted, via threaded fasteners 138, to the crankcase port 110 via an annular mounting flange 140 which is sealingly connected to the tube 134 at a medial location thereof. In this regard, the annular mounting flange 140 is connected, also via the threaded fasteners 138, to an entry port 142 formed in the housing 106 at the first stage chamber 116. A floor 144 is formed at a bottom portion of the tube 134, wherein the floor provides a confinement demarcation for the wire mesh filtration media 132 so that a freely open passageway 146 is formed between the tube 134 and the floor. By "bottom portion" is meant that upon installation, the passageway 146 should be located at the vertically lowest point of the tube, wherein the preferred installation orientation of the tube is horizontal.

By way of preferred exemplification, the tube 134 may be 6.625 inches in diameter and 3.125 inches long. The mounting flange 140 is located at the mid-plane of the tube and the tube is horizontal with the passageway 146 at the lowest position. The wire mesh filtration media may be composed of knitted 0.006 inch diameter steel wire.

Figure 5A:
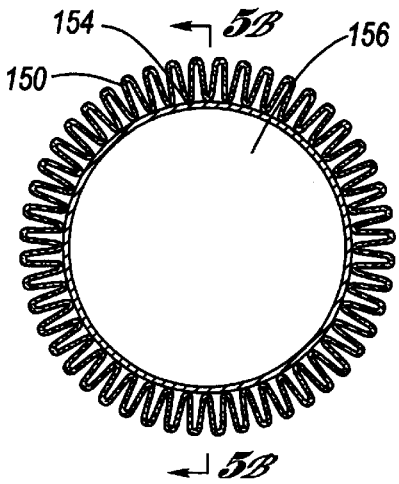
FIG. 5A is a partly sectional end view of a second stage filter of the two-stage filtration assembly according to the present invention, seen along line 5A—5A of FIG. 5B.
Figure 5B:
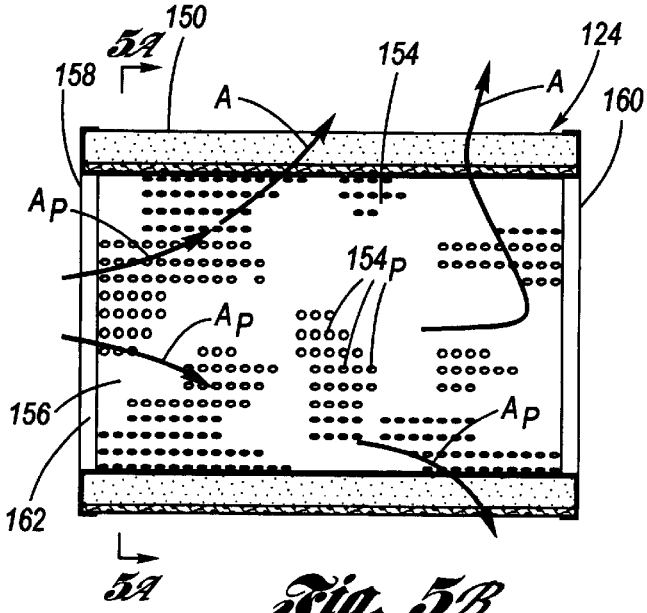
FIG. 5B is a partly sectional view along line 5B—5B in FIG. 5A.

Referring additionally to FIGS. 5A and 5B, the second stage filtration assembly 124 will be discussed.

The second stage filtration assembly 124 includes a second stage filter 150 featuring a web filtration media, preferably a non-woven fiberglass, and is mounted at an acute angle cc (preferably 20 degrees with respect to a horizontal reference H, i.e., with respect to the cylindrical axis of the tube 134), angling downwardly toward the first stage filtration assembly. The second stage filter 150 is cylindrical, having a pleated configuration annularly arranged on a perforated metal inner can 154 which defines thereinside a filter cavity 156. First and second end caps 158, 160 are connected (by welding) to the inner can 154 and trap the web filtration media therebetween. The first end cap 158 is annular, wherein a cap aperture 162 which is aligned with the filter cavity 156. The second end cap 160 closes the filter cavity. The second stage filtration assembly 124 is mounted in a filter seat 166 of the second stage chamber 118 so that crankcase air from the first stage filtration assembly passes through the cap aperture 162 into the filter cavity 156, through the perforations 154*p* of the inner can 154, and then passes out through the web filtration media in perpendicular relation to the pleating (see FIG. 5B). The second stage filtration assembly 124 is serviced by a removable service panel 164 of the housing 106 (compare FIGS. 2 and 3, wherein FIG. 3 shows the door removed).

By way of preferred exemplification, the second stage filtration assembly has an outer diameter of 12 inches, an inner diameter of 9 inches, and a length of 16 inches. The second stage filtration assembly is mounted to the housing via a four bar mechanism at a 20 degree angle relative to the horizontal reference H with the lowest point adjacent the first stage filtration assembly so that oil collected can drain into the passageway 146. The preferred material of the web filtration media is non-woven fiberglass having multiple wraps of fiberglass sheet, wherein the fibers range in size from 2 to 50 microns and a density thereof is 6 to 12 $lb/ft^3$.

As shown at FIG. 3, the evacuator 102 of the crankcase ventilation system 170 (which collectively includes the evacuator and the oil separator in the form of the two-stage filtration assembly 100) is interfaced with the housing 106 at the evacuation chamber 120 for providing a negative pressure downstream of the second stage filtration assembly 124 which draws crankcase air from the crankcase port 110 and expels it to the exhaust port 114.

In operation, in response to operation of the evacuator 102, which is preferably a nozzle-based system, crankcase air $A_{DP}$ laden with drops and particles of oil flows (see FIGS. 3, 4A and 5B) from the crankcase 108, serially through the first and second stage filter assemblies 122, 124, through the evacuator 102 and then out the exhaust port 114. The first stage filtration assembly serves to keep splashed oil S and large oil droplets of the crankcase air $A_{DP}$ from migrating to the second stage filtration assembly, and drains oil back to the crankcase. At the entry to the second stage filtration assembly, the crankcase air $A_p$ is now only laden with smaller suspended oil particles that the first stage filter could not eliminate. The oil particles are now filtered out of the crankcase air, wherein oil droplets D that form thereat will drain back to the crankcase through the passageway 146. Thus, because of the two-stage filtration system according to the present invention, crankcase air $A_{DP}$ laden with large oil drops and smaller oil particles is effectively filtered to provide at the evacuator 102 crankcase air A having an acceptable composition for delivery to the exhaust.

To those skilled in the art to which this invention appertains, the above-described preferred embodiment may be subject to change or modification. Such change or modification can be carried out without departing from the scope of the invention, which is intended to be limited only by the scope of the appended claims.

What is claimed is:

1. A two stage filtration assembly for a crankcase ventilation system comprising:

a housing having a first stage chamber and a second stage chamber communicating with said first stage chamber;

a first stage filtration assembly communicating with said first stage chamber, said first stage filtration assembly including a first filtration media; and a second stage filtration assembly disposed in said second stage chamber, said second stage filtration assembly including a second stage web filtration media;

wherein air passing through said housing serially passes through said first and second filtration media; and wherein said second stage filtration assembly further comprises:

a perforated can having a first end and an opposite second end, said can defining a cavity therewithin;

a first end cap connected to said first end, said first end cap having an aperture aligned with said cavity; and a second end cap connected to said second end, said second end cap closing said cavity at said second end;

wherein said web filtration media is pleated and overlays said can and is trapped between said first and second end caps.

2. The two-stage filtration assembly of claim 1, wherein said first stage filtration media comprises a wire mesh filtration media for filtering a first range of size of oil particles from the air.

3. The two-stage filtration assembly of claim 2, wherein said first stage filtration assembly further comprises a tube, wherein said wire mesh filtration media is disposed in said tube, and wherein said tube is sealingly interfaced with said housing.

4. The two-stage filtration assembly of claim 3, wherein said first stage filtration assembly further comprises a passageway formed therein which allows oil from said second stage filtration assembly to pass therethrough.

5. The two-stage filtration assembly of claim 2, wherein said web filtration media comprises non-woven fiberglass.

6. The two stage filtration assembly of claim 1, wherein said perforated can is mounted at an acute angle with respect to a horizontal reference so that oil collected thereat drains therefrom into said passageway.

7. A crankcase ventilation system interfaced between a crankcase port and an exhaust port of a Diesel engine, comprising:

an evacuator communicating with the exhaust port; and an oil separator comprising a two stage filtration assembly, comprising:

a housing having a first stage chamber communicating with the crankcase port and a second stage chamber communicating with said first stage chamber, said second stage chamber communicating with said evacuator;

a first stage filtration assembly communicating with said first stage chamber and the crankcase port, said first stage filtration assembly including a first filtration media; and a second stage web filtration assembly disposed in said second stage chamber, said second stage filtration assembly including a second stage filtration media;

wherein crankcase air exiting the crankcase port passes through said housing under urging of said evacuator, wherein the crankcase air passes serially through said first and second filtration media before exiting into the exhaust port; and wherein said second stage filtration assembly further comprises:

a perforated can having a first end and an opposite second end, said can defining a cavity therewithin;

a first end cap connected to said first end, said first end cap having an aperture aligned with said cavity; and a second end cap connected to said second end, said second end cap closing said cavity at said second end;

wherein said web filtration media is pleated and overlays said can and is trapped between said first and second endcaps.

8. The crankcase ventilation system of claim 7, wherein said first stage filtration media comprises a wire mesh filtration media for filtering a first range of size of oil particles from the air.

9. The crankcase ventilation system of claim 8, wherein said first stage filtration assembly further comprises a tube, wherein said wire mesh filtration media is disposed in said tube, and wherein said tube is sealingly interfaced with said housing.

10. The crankcase ventilation system of claim 9, wherein said first stage filtration assembly further comprises a passageway formed therein which allows oil from said second stage filtration assembly to pass therethrough.

11. The crankcase ventilation system of claim 7, wherein said web filtration media comprises a non-woven fiberglass.

12. The crankcase ventilation system of claim 7, wherein said perforated can is mounted at an acute angle with respect to a horizontal reference so that oil collected thereat drains therefrom into said passageway.

13. A two-stage filtration assembly for a crankcase ventilation system comprising:

a housing having a first stage chamber and a second stage chamber communicating with said first stage chamber;

a first stage filtration assembly communicating with said first stage chamber, said first stage filtration assembly including a first filtration media; and a second stage filtration assembly disposed in said second stage chamber, said second stage filtration assembly including a second stage filtration media;

wherein air passing through said housing serially passes through said first and second filtration media;

wherein said first stage filtration assembly further comprises a passageway formed therein which allows oil from said second stage filtration assembly to pass therethrough; and wherein said second stage filtration assembly is mounted at an acute angle with respect to a horizontal reference so that oil collected thereat drains therefrom into said passageway.

* * * * *